United States Patent [19]

Singewald et al.

[11] 3,941,685

[45] Mar. 2, 1976

[54] PROCESS FOR ELECTROSTATIC SEPARATION OF PYRITE FROM CRUDE COAL

[75] Inventors: Arno Singewald, Kassel-Wilhelmshohe; Gunther Fricke, Neuhof, both of Germany

[73] Assignee: Kali und Salz Aktiengesellschaft, Kassel, Germany

[22] Filed: Aug. 15, 1974

[21] Appl. No.: 497,636

[52] U.S. Cl. ..... 209/9; 209/127 R

[51] Int. Cl.[2] ..... B03B 1/04

[58] Field of Search..... 209/9, 11, 127 R, 127 A, 209/127 B, 127 C, 2

[56] References Cited

UNITED STATES PATENTS

| | | | |
|---|---|---|---|
| 1,153,182 | 9/1915 | Schniewind | 209/127 A |
| 2,154,682 | 4/1939 | Johnson | 209/127 A |
| 3,052,349 | 9/1962 | Snow | 209/9 |
| 3,073,447 | 1/1963 | Autenrieth | 209/127 R |
| 3,217,876 | 11/1965 | Autenrieth | 209/9 |
| 3,225,924 | 12/1965 | Autenrieth | 209/9 |
| 3,835,996 | 9/1974 | Singewald et al. | 209/9 |

FOREIGN PATENTS OR APPLICATIONS

| | | | |
|---|---|---|---|
| 744,805 | 11/1943 | Germany | 209/127 R |
| 870,832 | 7/1949 | Germany | 209/127 R |
| 681,171 | 3/1964 | Canada | 209/127 R |

*Primary Examiner*—Robert Halper

*Attorney, Agent, or Firm*—Haseltine, Lake & Waters

[57] ABSTRACT

An improved process is disclosed for electrostatic separation of pyrite from powdered crude coal comprising vigorously mixing the powdered crude coal with a selected fatty acid glyceride as a conditioning substance and conducting the electrostatic separation at a relative humidity of 2.5–20% and a temperature between room temperature and 100° C. In a multiple stage process yields of purified coal substantially greater than those of prior art processes can be obtained.

12 Claims, 1 Drawing Figure

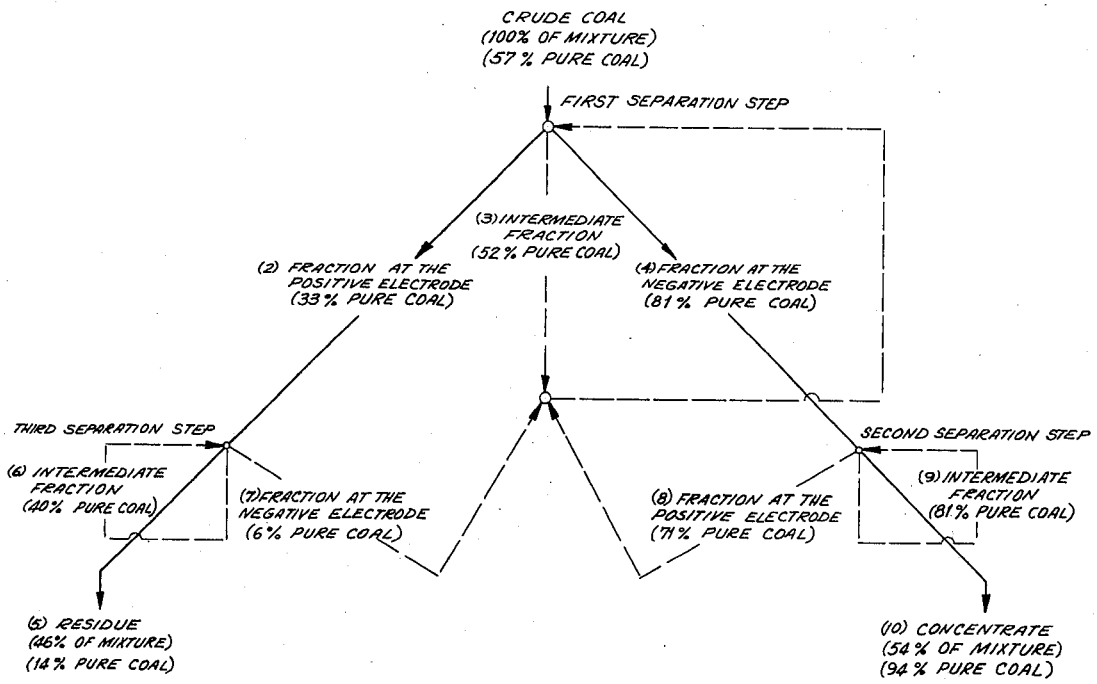

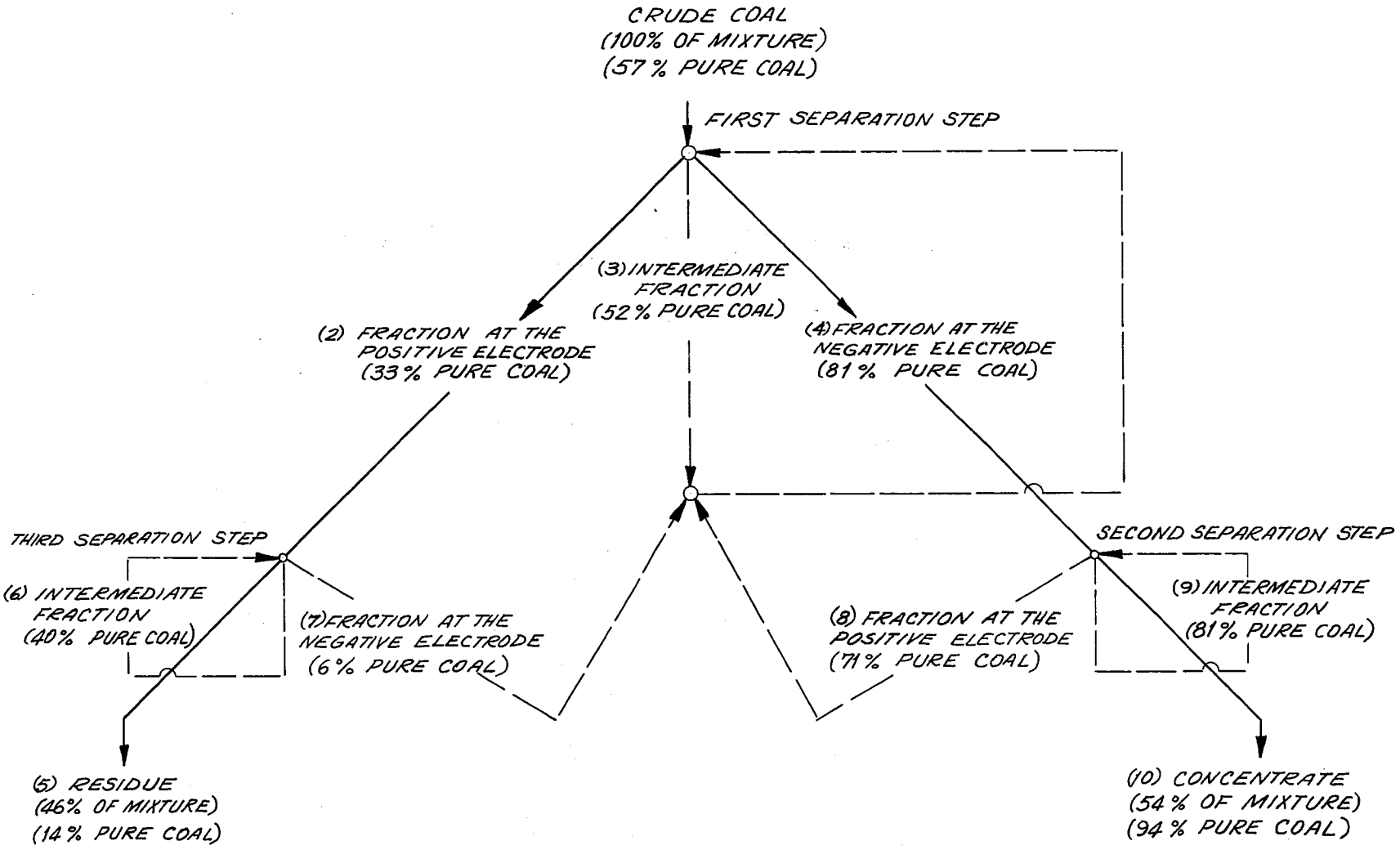
CRUDE COAL
(100% OF MIXTURE)
(57% PURE COAL)
FIRST SEPARATION STEP
(2) FRACTION AT THE POSITIVE ELECTRODE (33% PURE COAL)
(3) INTERMEDIATE FRACTION (52% PURE COAL)
(4) FRACTION AT THE NEGATIVE ELECTRODE (81% PURE COAL)
THIRD SEPARATION STEP
(6) INTERMEDIATE FRACTION (40% PURE COAL)
(7) FRACTION AT THE NEGATIVE ELECTRODE (6% PURE COAL)
(5) RESIDUE (46% OF MIXTURE) (14% PURE COAL)
SECOND SEPARATION STEP
(8) FRACTION AT THE POSITIVE ELECTRODE (71% PURE COAL)
(9) INTERMEDIATE FRACTION (81% PURE COAL)
(10) CONCENTRATE (54% OF MIXTURE) (94% PURE COAL)

PROCESS FOR ELECTROSTATIC SEPARATION OF PYRITE FROM CRUDE COAL

BACKGROUND OF THE INVENTION

A current goal of coal technology is to separate pyrite and coal from one another to prepare a coal of the greatest possible purity.

German Patent No. 744,805 discloses a process for electrostatic separation of mixtures of coal and ore by applying an oily wetting agent to increase the surface resistance of at least a portion of the mixture. The wetting agent also has the purpose of increasing the adhesion of the wetted separable material to the wetted electrode. The oil used is not further described as to its chemical composition. The separation of the components relies on the conductivity difference between the components which is produced or enhanced by the wetting agent and not on the contact electric charge of the components as in the process of this invention.

The process of this invention uses a different method of solving the problem which has significant technical advantages.

U.S. Pat. No. 3,073,447 discloses an electrostatic beneficiation of crude potassium salts containing langbeinite into a sylvine concentrate, using known potassium chloride selective reagents, and a langbeinite concentrate using langbeinite-selective reagents at a temperature between 40° and 150°C. Table 1, line 15, shows that sylvine is also recovered by separation using glycerine esters of fatty acids at 60°C., a method which, in comparison to other potassium chloride specific methods, shows a very poor yield of $K_2O$. According to the process of this invention, no glycerine esters of fatty acids are used but rather selected glycerides of stearic, palmitic, oleic, linoleic, and linolenic acids.

In contrast with the above technology, the process of this invention uses other conditioning substances and produces a surprisingly selective separation. A coal concentrate containing over 80% pure coal is attained with a yield of at least 80%.

Various authors have addressed themselves in "Aufbereitungs-Technik" (No. 4/1970, pages 207–220) to the problem of separation of pyrite from coal dust in electric and magnetic fields.

The separation was undertaken in the electrodynamic field of a cylindrical separator at a temperature between 14° and 34°C. and relative humidity of 20–90%. As conditioning substances for altering the conductivity, $HNO_3$, $H_2SO_4$, $H_2O_2$, and $KM_gPO_4$ were employed. The report states concerning the separation results:

"From a complete review of all the results, which were obtained in numerous experiments with the electrodynamic cylindrical separator, it was abandoned, since the separation results in all experiments — even in the case of the most favorable assumptions about raw materials — were unsatisfactory."

These investigations did not suggest the conditioning means used in the process of this invention. Rather, the prior technology proceeded in an entirely different direction in which separations were made using differences between conductors and non-conductors and not by means of contact electric charges. These processes have the disadvantage of a low specific output of the cylindrical separator, since the electric field for charging and separation must come in contact with each mineral particle at the charging electrode for the purpose of charging and charge equalization.

SUMMARY OF THE INVENTION

According to the process of this invention which operates with contact electric charges, the electric field serves only for separating components according to their charge. The specific throughput of the process of the invention is greater by a factor of 40 than that of the above scheme according to present technology.

A process for electrostatic separation of pyrite from crude coal at a temperature from room temperature to about 100°C. has now been found in which the powdered crude coal is vigorously mixed with glycerides of the high and middle saturated and unsaturated fatty acids as conditioning substances for between 10 seconds and 30 minutes, and at relative humidity of about 2.5 to 20% is separated by known procedures in one separation step into a first purified coal concentrate containing over 80% purified coal with a yield of at least 80% and a first residue, and a first intermediate fraction is recovered which may be recycled into the starting material.

DESCRIPTION OF THE PREFERRED EMBODIMENTS

A process has further been found in which mono-di-, and tri-glyceride esters of stearic, palmitic, oleic, linoleic, and linolenic acids are used as conditioning substances in quantities of about 100–200 grams per ton of crude coal, preferably 200–500 grams per ton, and the separation of the material is carried out at 30°–60°C. at a relative humidity of 5–15%. Furthermore, a process has been discovered in which the first purified coal concentrate, without reconditioning and without heating, is separated in a second separation step into a second purified coal concentrate with over 90% pure coal and with a yield of at least 90%, a second residue which is recycled into the starting material and a second intermediate fraction which is recycled into the first purified coal concentrate. By way of example, crude coal of the following particle size is used for the separation according to the process of this invention:

| Particle Size (mm) | % |
|---|---|
| larger than 1.0 | 2.0 |
| 1.0 – 0.8 | 2.7 |
| 0.8 – 0.5 | 15.3 |
| 0.5 – 0.25 | 33.0 |
| 0.25 – 0.16 | 22.7 |
| 0.16 – 0.1 | 14.1 |
| smaller than 0.1 | 10.2 |

The material for purification contains about 57% pure coal. The pyrite content is about 4.3%, the silica content about 8.3%, and the total sulfur content about 2.8%. This crude coal was separated at a relative humidity of 5% and a temperature of 58°C. in a free falling plate-type separator with a throughput of 5 tons per hour at a field strength of 4 Kilovolts per centimeter. 500 grams of conditioner were used per ton of crude coal.

The results of the separation are shown in the following table for one stage of separation. The intermediate fraction is the difference between the initial material (100%) and the total of concentrate and residue. The time of mixing of the conditioning material with the starting material was about 1 minute.

| Example No. | Conditioning Substance | Concentrate (Fraction at the negative electrode Percent of Mixture | Concentration of Pure Coal (%) | Residue (Fraction at the positive electrode) Percent of Mixture | Concentration of Pure Coal (%) |
|---|---|---|---|---|---|
| 1 | Vegetable oil | 26 | 81 | 30 | 27 |
| 2 | Bone oil | 32 | 78 | 32 | 31 |
| 3 | Peanut oil | 32 | 84 | 31 | 29 |
| 4 | Olive Oil | 35 | 84 | 33 | 27 |
| 5 | Glycerine and Oleic acid | 35 | 85 | 34 | 29 |
| 6 | Poppy-seed oil | 27 | 86 | 33 | 32 |
| 7 | Sunflower oil | 28 | 84 | 35 | 36 |
| 8 | Castor oil | 34 | 85 | 32 | 29 |
| 9 | Monoolein | 31 | 81 | 33 | 33 |
| 10 | Monostearin | 29 | 78 | 30 | 31 |
| 11 | Tripalmitin | 28 | 84 | 35 | 28 |
| 12 | Tristearin | 30 | 84 | 34 | 29 |

The following examples show the dependence of the degree of separation on the proportion of conditioning material for the same starting material at 43°C. and a relative humidity of 10% using olive oil as the conditioning means.

| Example No. | Conditioner grams/ton | Concentrate (Fraction at negative electrode) Fraction of Mixture (%) | Pure Coal (%) | S (%) | Residue (Fraction at positive electrode) Fraction of Mixture (%) | Pure Coal (%) | S (%) |
|---|---|---|---|---|---|---|---|
| 13 | 2,000 | 36 | 87 | 1.3 | 30 | 30 | 4.0 |
| 14 | 1,000 | 31 | 87 | 1.3 | 32 | 30 | 4.0 |
| 15 | 500 | 27 | 86 | 1.4 | 33 | 37 | 3.8 |
| 16 | 250 | 28 | 84 | 1.5 | 32 | 30 | 4.0 |

These results establish that the separation results are already attained with proportions of 200–500 grams per ton of conditioning material.

The further separation in the second and third separative steps is described in the following examples and illustrated in the flowsheet shown in the drawing.

The material to be beneficiated 1 is separated in the first step into three fractions, of which the first intermediate fraction 3 is recycled in a continuous process. The concentrate separated at the negative electrode and the residue falling at the positive electrode are separated without further conditioning, in a second and a third separation steps in which likewise three fractions are separated. The intermediate fractions in the second and third steps 6 and 9 are likewise recycled in the same separation step while the fractions 7 and 8 together with the intermediate fraction 3 are led back to the first separation step.

Typically, from a crude coal comprising 100% mixture, in a continuous process which comprises recycling of the intermediate fractions, the following products are obtained: 54% of the mixture as concentrate 10 containing 94.7 pure coal, 46% of the mixture as residue 5 containing 14% pure coal. The yield of pure coal amounts to about 88%.

We claim:

1. A process for electrostatic separation of particles of pyrite from powdered crude coal in a mixture thereof at a temperature between room temperature and 100°C, by contact electrification of said particles, comprising a. vigorously mixing said particles with a conditioning substance comprising glycerides of high and middle saturated and unsaturated fatty acids for a period of between 10 seconds and 30 minutes and in quantities of about 100–2000 grams per ton of powdered crude coal, thereby to form conditioned electrified particles thereof in said field, and b. separating said conditioned electrified particles in an electric field produced by a free falling plate type separator according to their charge at a relative humidity of about 2.5–20% whereby there is obtained a first purified coal concentrate, a first residue containing the greater portion of the pyrite, and an intermediate fraction.

2. An improved process according to claim 1, wherein said intermediate fraction is recycled into the initial powdered crude coal.

3. An improved process according to claim 1, wherein said glycerides are selected from the group consisting of the mono-, di- and tri-glyceride esters of stearic, palmitic, oleic, linoleic, and linolenic acids.

4. An improved process according to claim 1, wherein said glycerides are used in quantities of 200–500 grams per ton of powdered crude coal.

5. An improved process according to claim 1, wherein the separation is carried out at a temperature of 30°–60°C.

6. An improved process according to claim 1, wherein the separation is carried out at a relative humidity of 5–15%.

7. An improved process accroding to claim 1, wherein the first purified coal concentrate without further conditioning is separated in a second separation step into a second purified coal concentrate, a second residue, and a second intermediate fraction.

8. An improved process according to claim 7, wherein said second intermediate fraction is recycled into said first purified coal concentrate.

9. An improved process according to claim 7 wherein said second residue is recycled into said powdered crude coal.

10. An improved process according to claim 1, wherein said first residue without further conditioning is separated in a third separation step into a third purified coal concentrate, a third intermediate fraction, and a third residue.

11. An improved process according to claim 10 wherein said third intermediate fraction is recycled into said first residue.

12. An improved process according to claim 10 wherein said third purified coal concentrate is recycled into the powdered crude coal.

* * * * *